United States Patent [19]

Kulman

[11] Patent Number: 4,945,569

[45] Date of Patent: Jul. 31, 1990

[54] HEARING AID

[76] Inventor: Jaromir Kulman, Freiestrasse 25, CH-8800 Thalwil, Switzerland

[21] Appl. No.: 302,418

[22] Filed: Jan. 26, 1989

[30] Foreign Application Priority Data

Jan. 27, 1988 [DE] Fed. Rep. of Germany ..... 3802250

[51] Int. Cl.[5] ..... H04R 25/02

[52] U.S. Cl. ..... 381/68.6; 381/68; 181/130; 181/135

[58] Field of Search ..... 381/68, 68.6, 187, 69, 381/69.1, 69.2; 181/130, 135

[56] References Cited

U.S. PATENT DOCUMENTS 3,209,382 9/1965 McCarrell et al. ..... 381/187

3,852,540 12/1974 Diethelm ..... 381/68.6

*Primary Examiner*—Jin F. Ng

*Assistant Examiner*—M. Nelson McGeary, III

*Attorney, Agent, or Firm*—Lee, Mann, Smith, McWilliams & Sweeney

[57] ABSTRACT

An earwax-protective device having a yoke joined with an auditory passage portion of a hearing aid which makes it possible to easily remove accumulations of earwax without damaging sensitive electrical components in the hearing aid.

10 Claims, 3 Drawing Sheets

HEARING AID

The invention relates to a hearing aid installable in an auricle, with an auricular part consisting of plastic and a conical auditory passage part presenting at least one sound emergence opening slidable into the auditory canal, as well as with electrical components installed in the hearing aid, namely the microphone, an amplifier, a receiver, a battery and a sound-volume regulator.

A category-forming hearing aid is described in DE-36 13 165 Cl. Here the sound tube of the receiver issues in the zone of a sound-emergence opening provided on end side of the auditory canal part, which opening is unprotected, that in the wearing of the device it can be clogged in the course of time with ear wax. The hearing aid wearer is tempted to free this opening again by manipulation, in which process because of the small size of this sound-emergence opening this is very difficult, and in the second place the hearing aid proper and the electrical components in the hearing aid are damaged.

These disadvantages have already been perceived, and in DE-GM 19 79 669 it is proposed to slide into the end section of the sound channel open to the auditory canal a fitted and changeable tubelet. If this tubelet is fouled and if the opening of the tubelet become clogged, the fouled tubelet can be drawn out of the end section of the sound channel and be replaced by a new tubelet. This arrangement still entices the hearing aid user to carry out these operations himself and in so doing to damage the apparatus or else it compels the hearing aid user to visit a maintenance workshop, which is felt to be troublesome.

In W. German Patent DE-PS 12 59 951 a hearing aid is proposed in which in the zone of the sound emergence a cover part is clipped onto the sound-emergence opening, this cover part having at least one sound-emergence opening. In actual practice it has proved that by this arrangement the hitherto existing disadvantages cannot be avoided, since with the small structural size of an in-the-ear hearing aid the cover plate can only have such small openings, which are very rapidly jammed with ear wax. Here, too, a changing is possible only with difficulty.

In practice, therefore, it has been proposed to use an ear-wax protective plate which is constructed in the basic structure similarly to the arrangement according to DE-PS 12 59 951, but which is formed in such a way that in connection with a special device a detaching of the ear-wax protective plate from the hearing aid is possible and that then by a simple pressing-on a new ear wax-protective plate can be placed on the apparatus.

This known arrangement has the disadvantage that, since it is arranged to be easily detachably at the outer end zone of the auditory passage part, it can also be detached in the ear, for example in the removal of the hearing aid, especially if a very narrow auditory canal is present in the ear. The removal of the ear wax-protective place then present in the ear requires a physician.

Also, the gap remaining between the protective plate and the auditory passage part is very small. This promotes ear wax granule formation and leads to a rapid clogging. Underlying the invention is the problem of creating a protective device for the sound-emergence opening of an in-the-ear hearing aid which is firmly joined with the hearing aid, and therefore, does not have to be changed, which, however, also gives a layman and an older person the possibility of removing possibly adhering ear wax foulings rapidly, in order therewith to be make sure that the performance capacity of the hearing aid is not restricted by ear wax fouling. This problem underlying the invention is solved by the subject matter of the main claim.

Advantageous further developments are provided in the subclaims.

In other words, according to the invention the end part of the auditory passage part ends relatively bluntly and beyond this end side of the auditory passage part there projects a tube section which is held fast in the auditory passage part. This tube section forms the sound emergence opening and this tube section is overlapped by a yoke, in which arrangement the sound-emergence opening of the tube section can have opposite the yoke, a small bore which serves as sound bore. With such an arrangement ear wax does collect to be sure on the end side of the auditory passage part, but this ear wax hardly tends to granule formation and, moreover, can be easily removed with a small brush, in which process the sound emergence opening proper in the tube section remains free, since this tube section projects beyond the end side of the auditory canal part. A cleaning of the bore provided in the yoke, for example with the aid of a needle or of a little brush, cannot lend to a damaging of the electrical components of the hearing aid that are accommodated in the auditory passage part.

In the drawing, examples of the invention are represented and explained in the following:

Figure 1:
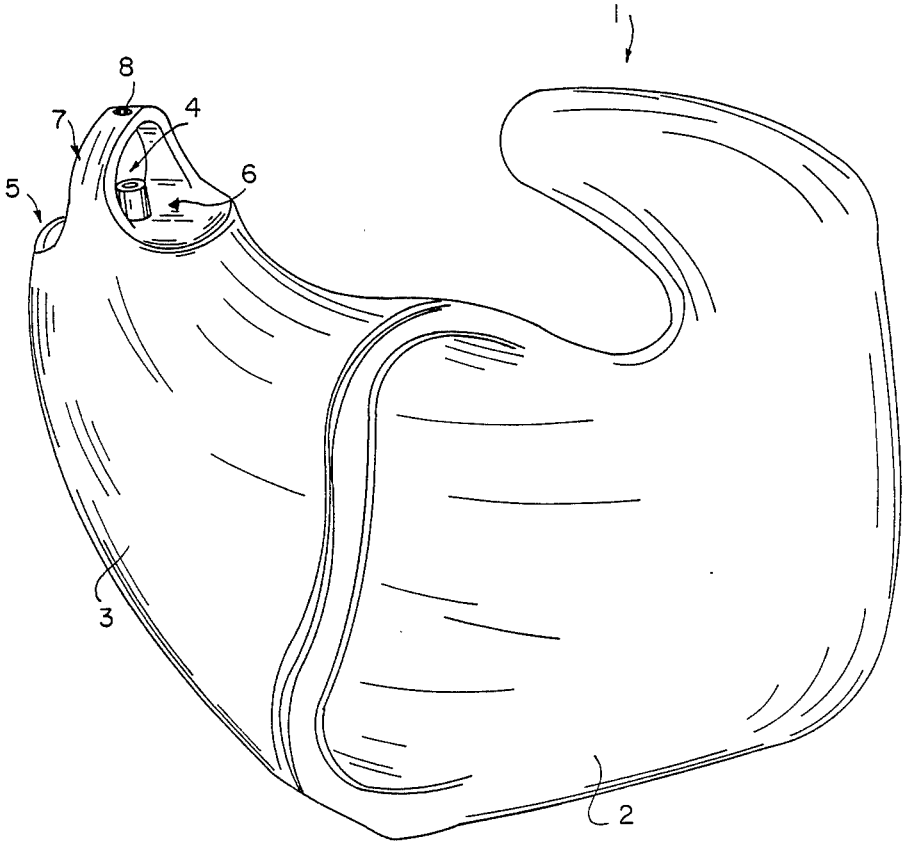
FIG. 1 shows a hearing aid in perspective representation with omission of the electrical components, in which the yoke of the invention is made in one piece with the auditory canal part.

In the drawings there is a hearing aid 1 which consists essentially of an auricle part 2 and an auditory canal part 3. The auditory canal part 3 ends on end side in an end side 5 which is formed subsantially flat and in which there is arranged a lead-through bore.

The sound emergence opening is formed by a tube section 6, for example a plastic tube, which as sound channel leads in the direction to the tympanic membrane and which projects upward beyond the end side 5, so that the lead-through bore in the cleaning of the end side 5, for example with a brush, does not come in contact at all with the brush.

The tube section 6 is overlapped by a yoke 7 which is rounded and therewith anatomically correctly formed and which in the disclosed embodiment is formed materially homogeneously from the wall of the auditory canal part. This yoke 7 has in its apex and lying opposite the sound emergence opening 4 of the tube section 6, a bore 8 which serves as sound bore.

It will be observed that with the new arrangement it is possible to bring about an easy removal of the ear wax accumulating in the zone of the end side 5. Further, a detaching of components in removing the hearing aid from the ear is not possible.

A complicated handling of any removable components is avoided, so that the hearing aid can be maintained without problems, and also by older persons. Beyond these advantages a diffused sound emergence is assured which corresponds to the normal sound sensing of the human being better than a directed sound emergence such as is still usual in many hearing aids.

Figure 2:
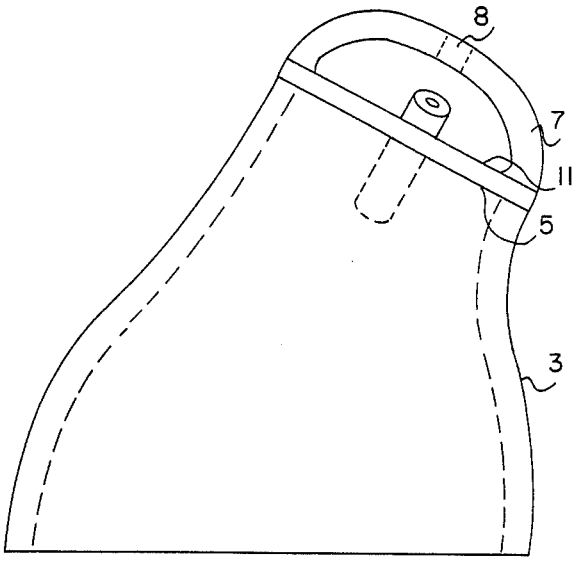
FIG. 2 shows a hearing aid in side view in which the yoke with base plate is cemented and adapted.
Figure 3:
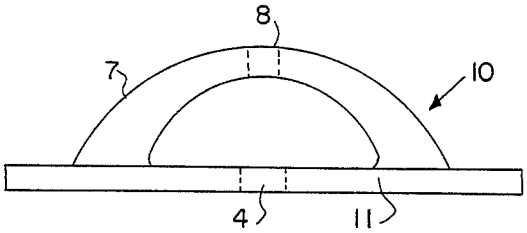
FIG. 3 is a side view of a yoke with base plate in unprocessed form.

In the technical laboratories for hearing aids the auricular and auditory-canal parts must be adapted in individual processing to the particular patient. In the embodiment discussed according to FIG. 1 the yoke 7 is made in one piece from the same material of which the auditory canal part consists. Such a manufacture, however, is relatively complicated; moreover there is lacking a characterization (Kennzeichnung) of the hearing aids. This can lead occasionally to side confusions by the wearers of the hearing aids. It is advantageous, therefore, to use an embodiment according to FIG. 2. In this variant, there is made the auditory canal part 3 adapted to the user and then the end is ground flat. This yields an open, flat end side 5. To this there is cemented a mass-produced element 10 which consists of a base platelet 11 with yoke 7 (FIG. 3). In advance there can be drilled at least the lead-through bore 4 in the base platelet 11. Finally, also the bore 8 in the yoke can be applied. The parts projecting beyond the end side 5 only then need to be ground off.

The base plates 11 with yoke 7 can be cast in mass production or injection-molded from a physiologically unobjectionable plastic. There the plastic can be dyed in the two audiometric colors, so that thereby the hearing aids are differently individualized for left and right. This solution offers, to be sure, considerable advantages in manufacturing technology and savings in costs, but still has slight problems. In the first place each base plate 11 with yoke 7 must be individually cast or injection molded. Further, the entire element 10 is wholly dyed, whereby the visual control with respect to a fouling is rendered difficult. Finally, two different-colored items of element 10 must be kept in stock.

These disadvantages are avoided by the embodiment according to FIGS. 4–7. As in the embodiment according to FIG. 2, again the auditory passage part 3 is ground flat in order to form an end side 5. To this there cemented not a whole element but only a colored base plate 11'. To the base plate 11' there is thereupon cemented a yoke 7' of colorless, transparent plastic. This variant obviates the aforementioned disadvantages and is especially well suited for mass production. For this embodiment of the invention the individual elements will again be briefly described.

Figure 6:
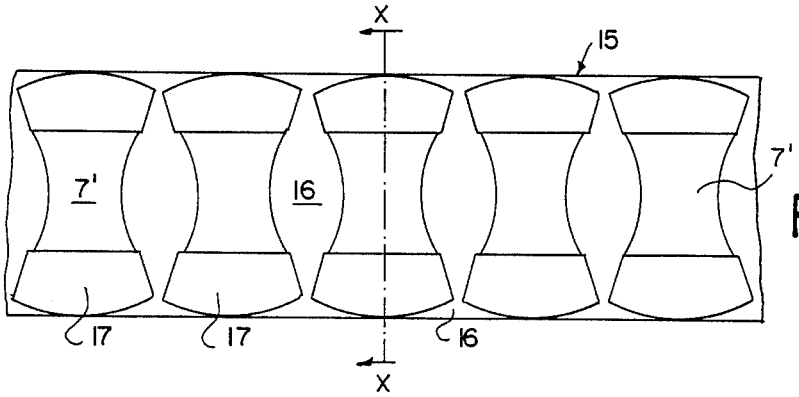
FIG. 6 shows several yokes that are made cohesively in bar form.

The colored base plates 11' are stamped into strips 12 subdivided with desired-break places 13. Simultaneously, each plate 11' is provided with a likewise stamped-in center marking 14 for the lead-through bore 4. The hearing aid technician thus provides the end side 5 with a rapid adhesive, and takes in hand the strip 12 and presses the outermost base plate 11' onto the end side 5. After a few seconds he breaks off the remaining strip along the ajoining desired-break place 13. Now he can conveniently apply the lead-through bore 4 at the marked place 14 and introduce the tube section 6. Also the yokes 7' are made cohesively, for example in the form of strips of ten. In this manner there can be manufactured with a simple mold a strip of 10 yokes per spraying (injection molding) or casting operation. In FIG. 6 there is represented such a strip 15, in which the yokes 7' are visible with the concave curvature upward. The carrier material 16 remains between each two adjacent, as well as laterally serving as desired break zone. Standing out raised are the yoke support surfaces 17 serve as adhesion surfaces.

Figure 7:
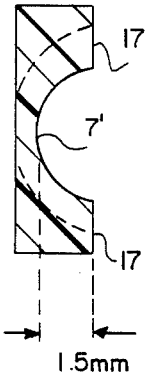
FIG. 7 shows a section through a yoke according to FIG. 6 along the line X—X.

Similarly as described earlier, as a next step the yoke support surfaces 17 are coated with rapid adhesive and pressed onto the already cemented-on base plate 11'. After a few seconds the adhesion is so great that the remaining part of the strip 15 can be broken off. Finally, it is still necessary only to grind off the projecting parts of the base plates and of the yokes 7', for example, say, along the broken lines 10 (FIG. 7).

Figure 4:
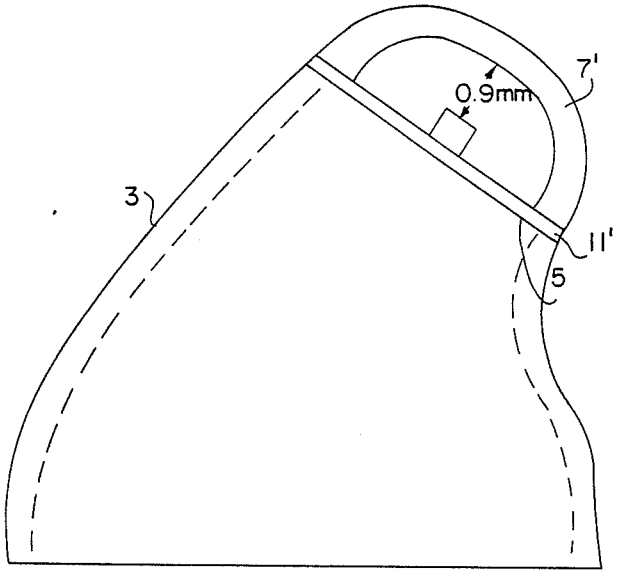
FIG. 4 shows another embodiment of a hearing aid in which the yoke and the base plate are applied separately.
Figure 5:
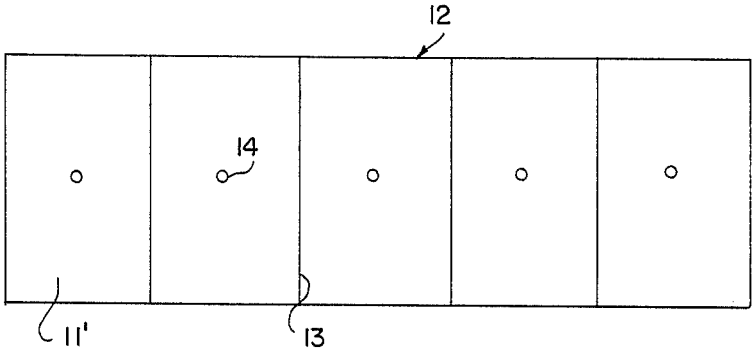
FIG. 5 shows several base plates made in strip form.

A hearing aid manufactured in this manner has all the aforementioned advantages. It can be made economically in mass production and the base plates can be produced in the desired audiometric colors, red for right and blue for left. In regard to the gear distance of the yoke, i.e., the size of the curvature preferably have the following dimensions: Width ca. 3.8 mm–5.0 mm, height minimally 1.5 mm. These dimensions are yielded from the conditions of the auditory canal, as well as from the experience of the granule formation of the ear wax. This leads to a clear distance of at least 0.9 mm between the yoke 7 bridging the emergence opening 4 in the form of an arch, and the tube section 6, as shown in FIG. 4.

I claim:

1. A hearing aid installable in an auricle and having an auricular part consisting of plastic and a conical auditory canal part slidable into the auditory canal presenting at an end side at least one sound emergence opening, and containing electrical components namely a microphone, an amplifier a receiver, and a battery and a sound-volume regulator, wherein the sound emergence opening is arranged in a tube section projecting beyond the end side of the auditory canal part and the tube section is bridged by a curved yoke joined with a wall of the auditory canal part, which yoke leaves free over the tue section a clear distance of at least 0.9 mm for accommodating the size of granule formation of earwax.

2. Hearing aid according to claim 1, wherein the yoke includes a bore traversing the yoke and being opposite the sound emergence opening.

3. Hearing aid according to claim 1, wherein the yoke is made homogeneously of the same material as, and in one piece with, the wall of the auditory canal part.

4. Hearing aid according to claim 1, wherein the auditory canal part is ground to an open, flat end side to which there is applied a base platelet and a prefabricated yoke.

5. Hearing aid according to claim 4, wherein the base platelet and the yoke are homogeneously made in one piece.

6. Hearing aid according to claim 5, wherein the base platelet and the yoke are made of material in audiometric colors.

7. Hearing aid according to claim 4, wherein the base platelet is made from a stamped strip with several base platelets which in each case are joined with one another over desired break places.

8. Hearing aid according to claim 4, wherein the yoke is made from a colorless, transparent, prefabricated strip which contains several yokes with yoke support surfaces which are joined with one another over desired break zones.

9. Hearing aid according to claim 7, wherein the strip is made of material in audiometric colors.

10. Hearing aid according to claim 7, wherein the individual base platelets have a center marking.

* * * * *